United States Patent [19]

Schmid et al.

[11] Patent Number: 5,039,966

[45] Date of Patent: Aug. 13, 1991

[54] TEMPERATURE-COMPENSATED TUNING SCREW FOR CAVITY FILTERS

[75] Inventors: Hartmut Schmid; Leif R. Mannerstrom, both of North Vancouver, Canada

[73] Assignee: Glenayre Electronics Ltd., Vancouver, Canada

[21] Appl. No.: 264,622

[22] Filed: Oct. 31, 1988

[51] Int. Cl.[5] ..... H01P 1/30; H01P 7/06

[52] U.S. Cl. ..... 333/229; 333/232; 333/234

[58] Field of Search ..... 333/229, 234, 231, 232, 333/235, 227, 209

[56] References Cited

U.S. PATENT DOCUMENTS

| | | | |
|---|---|---|---|
| 1,961,783 | 6/1934 | Roder | 336/20 |
| 2,103,515 | 12/1937 | Conklin et al. | 333/234 |
| 2,409,321 | 10/1946 | Stephan | 333/229 |
| 2,486,129 | 10/1949 | DeWalt et al. | 333/229 |
| 2,533,912 | 12/1950 | Bels | 333/234 |
| 2,637,782 | 5/1953 | Magnuski | 333/208 |
| 2,716,222 | 8/1955 | Smullin | 333/229 |
| 2,790,151 | 4/1957 | Riblet | 333/229 |
| 3,152,312 | 10/1964 | Johnson | 336/179 |
| 3,160,825 | 12/1964 | Derr | 333/229 X |
| 3,444,486 | 5/1969 | Banes et al. | 333/232 |
| 3,733,567 | 5/1973 | Johnson | 333/234 |
| 4,205,286 | 5/1980 | Parish | 333/229 X |
| 4,521,754 | 6/1985 | Ranghelli et al. | 333/234 X |

*Primary Examiner*—Eugene R. Laroche
*Assistant Examiner*—Benny Lee
*Attorney, Agent, or Firm*—Christensen, O'Connor, Johnson & Kindness

[57] ABSTRACT

A temperature-compensated tuning screw (22) for use with a cavity filter (20) is provided. The tuning screw (22) has an elongate body (36) with a longitudinal bore (38). A compensating member (40) is positioned at least partially within the bore (38). At least one compensation bimetallic washer (44) deflects with decreasing temperature and causes the compensating member (40) to protrude further from the body (36). The compensation bimetallic washers (44) become flatter with increasing temperature and a coil spring (42) causes the compensating member (40) to be partially retracted into the bore (38). The movement of the compensating member (40) causes an overall length, L, of the tuning screw (22) to change. The tuning screw (22) can be screwed into a hole (32) in a cavity filter (20) so that the tuning screw (22) penetrates the cavity filter (20) a distance, P. A temperature-induced change in L, $\Delta L$, causes a change in P, $\Delta P$. The change in penetration, $\Delta P$, compensates for temperature-induced changes in the geometry of the cavity filter (20) and substantially corrects for a temperature-induced frequency drift, $\Delta f'$.

46 Claims, 3 Drawing Sheets

TEMPERATURE-COMPENSATED TUNING SCREW FOR CAVITY FILTERS

FIELD OF THE INVENTION

This invention relates to cavity filters and, more particularly, to tuning screws for cavity filters.

BACKGROUND OF THE INVENTION

Cavity filters and their uses are well known in the electrical filter art. A cavity filter is basically a tuned electrical filter having a resonant frequency that is determined, in part, by the geometry of a cavity. The cavity may house component(s), such as a helical coil or rod, for example. Openings in the case surrounding the cavity may be used to affect the resonant frequency of the cavity filter. The cavity and the component(s) housed in the cavity (if any) create capacitance and inductance values that determine the resonant frequency of the cavity filter.

Cavity filters normally include a tuning apparatus that permits a user to precisely tune the filter to a nominal resonant frequency. Such an adjustment may be required to compensate for manufacturing tolerances and/or variations in materials used to build the cavity filter, which can cause the actual resonant frequency to vary from the nominal resonant frequency. One form of tuning apparatus is a tuning screw. Tuning screws are usually in the form of a threaded slug that is screwed into the cavity of the filter through a threaded hole. The amount that the tuning screw penetrates into the cavity controls the capacitance or the inductance values of the filter. Consequently, the resonant frequency of the cavity filter can be changed by changing the penetration of the tuning screw.

One problem associated with cavity filters is their sensitivity to temperature changes. Changes in temperature produce physical changes in cavity geometry that, in turn, produce changes in the electrical characteristics of the cavity filter. These capacitance and/or inductance changes cause the actual resonant frequency of the cavity filter to "drift" from the nominal resonant frequency. In many applications, cavity filters are required to operate over a wide temperature range. In such applications, temperature-induced frequency drift can be significant enough to make a cavity filter ineffective. For example, a significant lowering of the resonant frequency due to increasing temperatures will cause a corresponding lowering of the stopband cutoff frequency of a cavity filter. As a result, important signal information may be inadvertently filtered out by the cavity filter.

One approach that has been adopted by cavity filter manufacturers to correct the temperature-induced frequency drift problem is the use of temperature-stable materials in the construction of cavity filters. Cavity filters built with materials having low thermal expansion characteristics are less sensitive to temperature change than cavity filters built from other materials. However, when exposed to large temperature changes, even these cavity filters are subject to frequency drift problems, albeit to a lesser degree. In applications where a cavity filter forms a part of signal transmitting and receiving equipment operating with high frequency signals, even reduced frequency drift can adversely affect the sensitivity of the equipment or render the equipment totally useless.

Unfortunately, the tuning screws previously used in cavity filters are not effective in correcting temperature-induced frequency drift because prior art tuning screws react similarly to temperature changes as do the components of a cavity filter, i.e., prior art tuning screws expand and contract in response to increasing and decreasing temperatures in the same way that other cavity filter components respond to increasing and decreasing temperatures. As a result, prior art tuning screws may contribute to the temperature-induced frequency drift problem, rather than provide a solution to the problem.

As will be appreciated from the foregoing discussion, there has developed a need in the electrical filtering art for a cavity filter whose performance is less sensitive to temperature change over a wide range of temperatures. The present invention provides a temperature-compensated tuning screw that, when used with prior art cavity filters, actively compensates for temperature-induced changes in the cavity filter and thereby reduces the amount of temperature-induced drift in the resonant frequency of the cavity filter.

SUMMARY OF THE INVENTION

In accordance with the present invention, a temperature-compensated tuning screw for use with a cavity filter having a tuned frequency that drifts with changes in temperature is provided. The temperature-compensated tuning screw comprises: an elongate body having a longitudinal bore; a compensating member; and, first and second biasing elements. The compensating member is positioned substantially within the bore. The first biasing element, which is responsive to changes in temperature, is coupled to the compensating member so as to move the compensating member when the first biasing element responds to changes in temperature. The second biasing element loads the first biasing element. More specifically, the first biasing element moves the compensating member in a first direction in response to changes in temperature, and the second biasing element moves the compensating member in a second direction, which is opposite to the first direction.

When coupled to a cavity filter, the compensating member penetrates into the cavity of the cavity filter. The amount of penetration is controlled by the state of the biasing elements. Since the state of the first biasing element is temperature dependent, the amount of compensating member penetration is temperature dependent. In accordance with this invention, the amount of temperature dependent penetrating change is chosen to compensate for cavity geometry changes caused by temperature changes.

In accordance with further aspects of this invention, the first biasing element comprises at least one compensation bimetallic washer that is coupled to the compensating member and the bore such that the deflection of the washers moves the compensating member in the first direction. The second biasing element is a coil spring held in compression by the compensating member and the bore.

In accordance with alternative aspects of this invention, the second biasing element comprises at least one loading bimetallic washer that is coupled to the compensating member and the bore such that deflection of the washers moves the compensating member in the second direction. The loading and compensation bimetallic washers are oriented such that changes in temperature in one direction, e.g., an increase, cause movement of the compensating member is one direction and changes in temperature in the opposite direction, e.g., a decrease, cause movement in the other direction.

In accordance with other aspects of this invention, the bore comprises a head region, a shaft region, and a neck region that lies between the head region and the shaft region. The compensating member comprises a head coupled to one end of a shaft. The shaft passes through the neck region and lies substantially within the shaft region. The head lies substantially within the head region. The shaft passes through the compensation bimetallic washers, which are held in place by a back surface of the head region and a back surface of the head. The spring encircles the shaft and is held in place by an end of the shaft opposite the head, and a back surface of the shaft cavity.

As can be appreciated from the foregoing summary, the temperature-compensated tuning screw of the present invention changes its overall length so as to compensate for temperature-induced changes in a cavity filter. As a result, the temperature-compensated tuning screw substantially corrects for temperature-induced cavity geometry changes that cause the resonant frequency of the cavity filter to drift.

BRIEF DESCRIPTION OF THE DRAWINGS

The foregoing and other advantages of the present invention will become better understood by reference to the following detailed description when taken in conjunction with the accompanying drawings wherein.

DETAILED DESCRIPTION OF THE PREFERRED EMBODIMENT

There has developed a need in the electrical filter art for a cavity filter that is less sensitive to temperature changes over a wide range of temperatures. The present invention is a temperature-compensated tuning screw that can be used with prior art cavity filters to provide this result.

Figure 1:
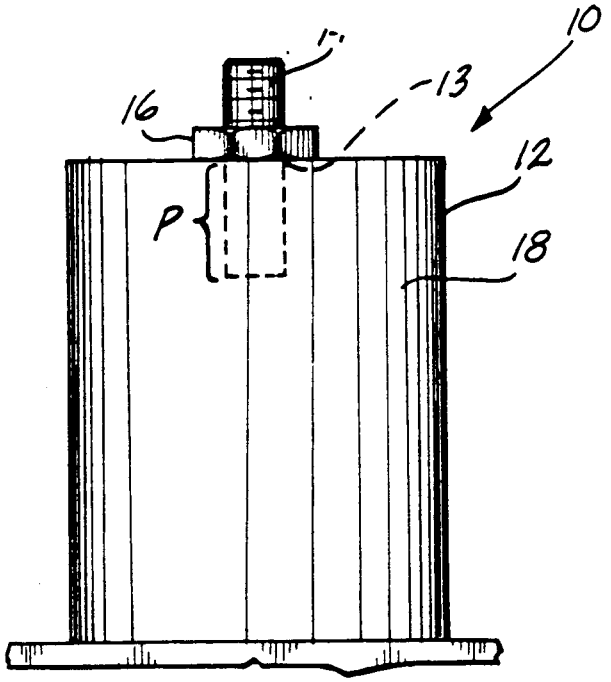
Fig. 1. PRIOR ART
FIG. 1 is a simplified elevation of a cavity filter and a prior art tuning screw.

FIG. 1 is illustrative of a cavity filter 10 having a prior art tuning screw 14 coupled thereto. The cavity filter 10 comprises: a case 12; a cavity 18 formed by walls of the case 12; and a threaded hole 13 that passes through one wall of the case 12. The prior art tuning screw 14 is an externally threaded slug that is screwed into the hole 13. The rotatable tuning screw 14 penetrates into the cavity 18 a distance, P and is secured by a lockdown nut 16.

The cavity filter 10 is tuned to a nominal resonant frequency, f, by adjusting the penetration, P, of the tuning screw 14. A change in the tuning screw penetration, $\Delta P$, will result in a change in the resonant frequency, $\Delta f$. As is well known in the filter art, cavity filters, such as the cavity filter 10 depicted in FIG. 1, are sensitive to temperature. More specifically, temperature changes cause changes in the geometry of cavity filters that result in changes in the resonant frequency, $\Delta f'$. Accordingly, the nominal resonant frequency, f, typically corresponds to a resonant frequency of the cavity filter 10 at some nominal temperature, T. For example, if the cavity filter 10 is intended for operation between operating temperatures of $-30°$ C. and $+60°$ C., the nominal resonant frequency, f, may correspond to a nominal temperature of 20° C. (i.e., $T=20°$ C.). Accordingly, the cavity filter 10 will remain tuned to the nominal resonant frequency, f, as long as the operating temperature remains at, or near, the nominal temperature, T. As noted above, a change in the operating temperature results in a change in the nominal resonant frequency, $\Delta f'$, i.e., a change in operating temperature causes a frequency "drift". In general, $|\Delta f'|$ increases as the operating temperature moves further away from the nominal temperature, T. As a result, the temperature-induced frequency drift, of a cavity filter 10 can be large when the deviation from the nominal temperature is large.

While the prior art tuning screw 14 can be adjusted initially to tune the cavity filter 10 to the nominal resonant frequency, f, it cannot compensate for a temperature-induced frequency drift. Rather, the prior art tuning screw 14 may actually increase the frequency drift problem. For example, as the operating temperature deviation from the nominal temperature increases, the geometry of the cavity 18 will change (i.e., expand), thereby changing electrical characteristics of the cavity filter 10. The changing electrical characteristics, in turn, cause f to change by some value of $\Delta f'$. Additionally, the prior art tuning screw 14 will also expand, i.e., lengthen, as operating temperature deviation increases. The increased length of the tuning screw 14 causes the penetration, P, to increase by some distance, $\Delta P$. As noted above, a change in the tuning screw penetration, $\Delta P$, results in a change in the resonant frequency, $\Delta f$. In the above example, both the expanding cavity 18 and the expanding tuning screw 14 create temperature induced drift values that result in lowering of the nominal resonant frequency, f.

Figure 2:
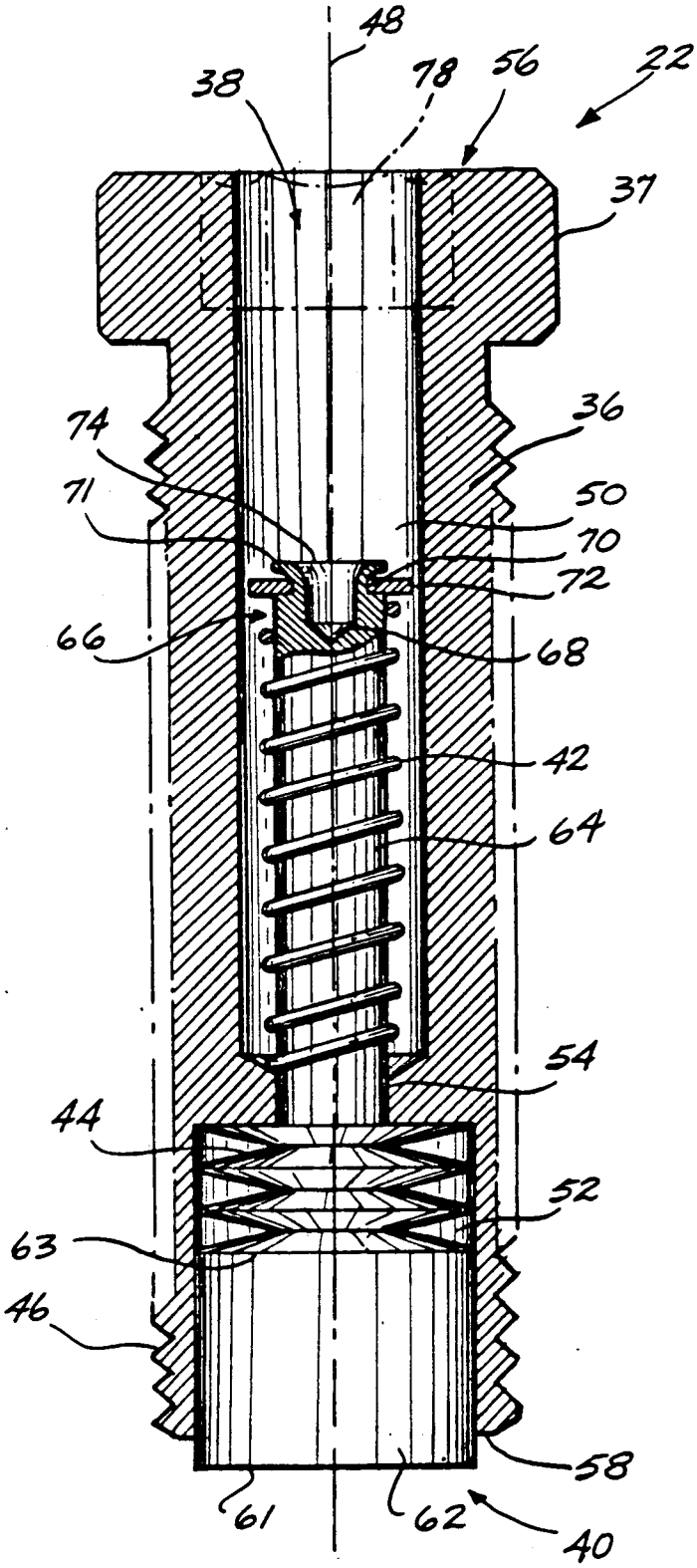
FIG. 2 is a sectional view of a preferred embodiment of a temperature-compensated tuning screw formed in accordance with the present invention.

FIG. 2 illustrates a preferred embodiment of a temperature-compensated tuning screw 22 formed in accordance with the present invention. As will become better understood from the following discussion, this embodiment of the temperature-compensated tuning screw 22 reduces its overall length (L) in response to increasing temperature and extends its overall length in response to decreasing temperature. As a result, unlike the prior art tuning screw 14 discussed above, the temperature-compensated tuning screw 22 can be used to reduce the temperature-induced frequency drift, of a cavity filter by compensating for temperature induced cavity geometry changes by changing the amount of tuning screw penetration in a compesatory manner.

The temperature-compensated tuning screw 22 comprises: a cylindrical elongate body 36; a thermal compensating member 40; a coil spring 42; and, six bimetallic washers 44. The body 36 includes a longitudinal bore 38 and has an integral hexagonal head 37 located at one end. As an alternative to the external hexagonal head 37, an internal hexagonal opening 78 could be employed as illustrated by phantom lines in FIG. 2. Preferably, the body 36, and the compensating member 40 are machined from a conductive, nonmagnetic material, such as brass, for example. If the tuning screw 22 is going to be used in a corrosive environment, other materials, such as aluminum or stainless steel, may be preferable over brass.

External threads 46 are preferably located along substantially the entire length of the body 36. The threads 46 and the cylindrical shape of the body 36 permit screwing the tuning screw 22 into, for example, the threaded hole 13 of the cavity filter 10 discussed above and illustrated in FIG. 1.

The longitudinal bore 38 is centered along the longitudinal axis 48 of the tuning screw 22. The bore 38 includes a cylindrical shaft region 50 that extends from one end 56 of the tuning screw 22 through the hexagonal head 37 and into the body 36, and a cylindrical head region 52 that extends from an opposite end 58 of the tuning screw 22 into the body 36. The shaft and head regions 50 and 52 are connected by a cylindrical neck region 54. The neck region 54 has a diameter substantially smaller than diameters of the shaft and head regions 50 and 52. In accordance with the preferred embodiment of the invention, the diameter of the head region 52 is substantially larger than the diameter of the shaft region 50. When measured along the longitudinal axis 48, the shaft region 50 is substantially longer than the head region 52, which is longer than the neck region 54. Obviously, other size relationships commensurate with achieving the objectives of the invention can be used if desirable.

The compensating member 40 includes a cylindrical head 62 located at one end of a shaft 64. The head 62 includes a back surface 63 located adjacent to the shaft 64 and a front surface 61 located at the outer end of the head. The diameter of the head 62 is substantially larger than a diameter of the shaft 64. The diameter of the head 62 is substantially equal to the diameter of the head region 52, such that the head 62 can be slidably received in the head region 52. The diameter of the shaft 64 is substantially equal to the diameter of the neck region 54, such that the shaft 64, but not the head 62, can be slidably received in the neck region 54. An end 66 of the shaft opposite the head 62 has a small axial bore 68 and a neck 70. An edge 71 of the neck 70 is flared outwardly by a stake 74 that is inserted into the bore 68. A retaining washer 72, mounted on a shoulder that surrounds the neck 70, is held in place by the flared edge 71.

The diameter of the holes in the six bimetallic washers 44 is slightly larger than the diameter of the shaft 64 and the diameter of the outer periphery of the bimetallic washers 44 is slightly less than the diameter of the head region 52. Further, the coil spring 42 is sized to be slidably mounted on the shaft 64 of the compensating member 40. The temperature compensated tuning screw 22 is assembled by mounting the six bimetallic washers 44 on the shaft 64 of the compensating member 40. Then the head 63 of the compensating member 40 is mounted in the head region 52 such that the shaft 64 passes through the neck region 54. As a result, the six bimetallic washers are located between the back surface 63 of the head 62 and a shoulder formed where the head region joins the neck region. Next the coil spring 42 is mounted on the shaft 64 and the retaining washer is mounted on the shoulder that surrounds the neck 70. Then the stake 74 is driven into the bore 68.

In accordance with the preferred embodiment of the invention, and as will be discussed more fully below, the bimetallic washers 44 are responsive to temperature changes lying within a particular range, and thus, produce a force that is temperature dependent. The force controls the position of the compensating member 40. Thus, the bimetallic washers 44 can be defined as compensation bimetallic washers. For example, in one particular working model of the temperature-compensated tuning screw 22, the compensation bimetallic washers 44 are responsive to temperature changes lying between −30° C. and 100° C. The compensation bimetallic washers 44, in the above example, flatten with increasing temperatures and deflect so as to become conical with decreasing temperatures within the temperature range (i.e., −30° C.–+100° C.). The compensation bimetallic washers 44 are stacked on the shaft 64 such that the deflection of one compensation bimetallic washer 44 is in the opposite direction of the deflection of the adjacent compensation bimetallic washer(s) 44. This stacking arrangement is further illustrated in FIG. 2, which depicts the compensation bimetallic washers 44 in conical states.

As will become better understood from the following discussion, the deflection of the compensation bimetallic washers 44 causes the overall length, L, of the temperature-compensated tuning screw 22 to increase with decreasing temperatures. An increase in temperature causes the compensation bimetallic washers to flatten, which, in combination with the expansion of the coil spring 42, causes the overall length, L, to decrease. More specifically, as the compensation bimetallic washers 44 deflect with decreasing temperature, they cause the compensating member 40 to protrude further from the end 58 of the body 36. Accordingly, the overall length of the tuning screw 22, L, as defined by the end 56 of the body 36 and the front surface 61 of the compensating member head 40, increases. With increasing temperatures, the compensation bimetallic washers 44 begin to flatten and the compensating member 40 is partially retracted by the expansion of the coil spring 42. Accordingly, the length, L, of the temperature-compensated tuning screw 22 decreases. At a high temperature (e.g., 100° C.), preferably, the compensation bimetallic washers 44 are sufficiently flat to permit the head 62 of the compensating member 40 to be fully retracted by the compression spring 42 into the head region 52. In this position the front surface 61 of the compensating member 40 is flush with the end 58 of the body 36 so that the length, L, of the tuning screw 22 is defined by the ends 56 and 58 of the body 36.

Figure 3:
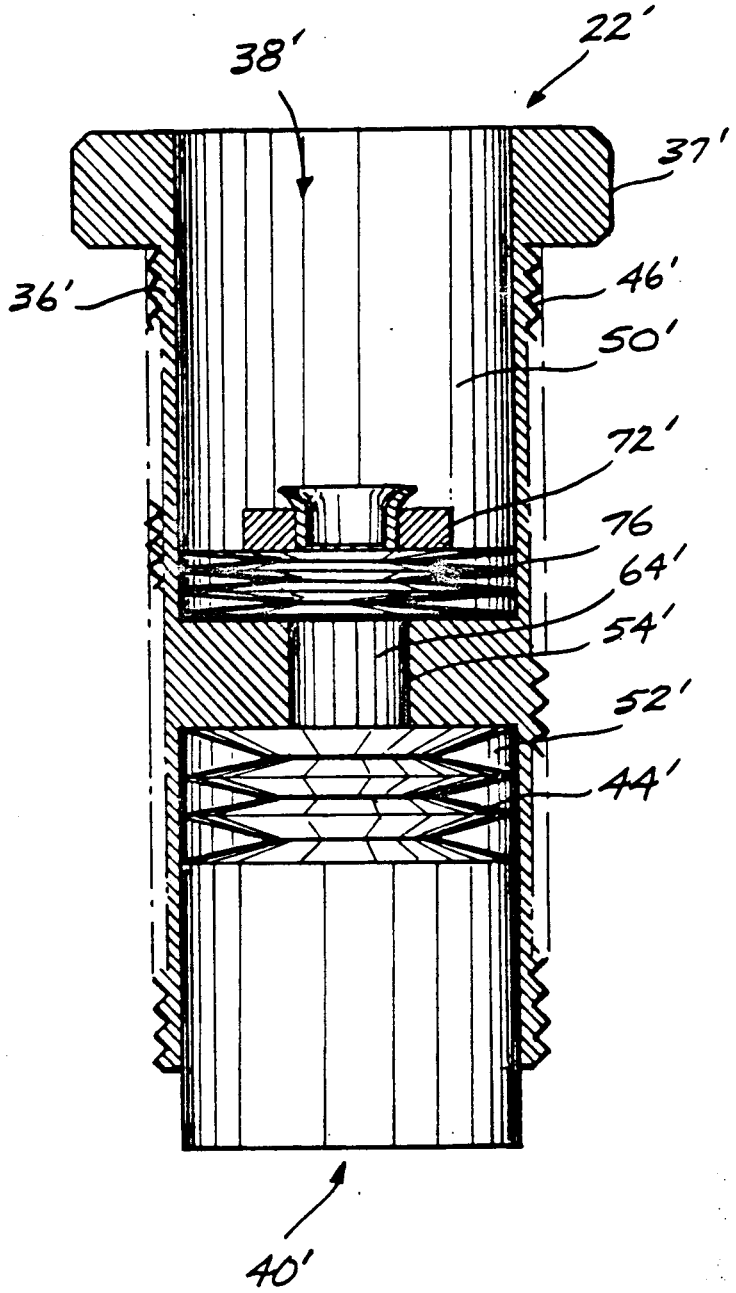
FIG. 3 is a sectional view of an alternative embodiment of the temperature-compensated tuning screw illustrated in FIG. 2.
Figure 4B:
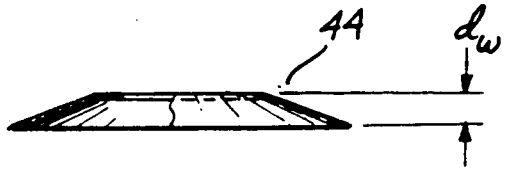
FIGS. 4A and 4B are elevations of a compensation bimetallic washer suitable for use in the temperature-compensated tuning screw depicted in FIG. 2; and, FIG. 5 is a simplified sectional view of a temperature-compensated tuning screw formed in accordance with the present invention mounted in a helical resonator-type cavity filter.
Figure 4A:
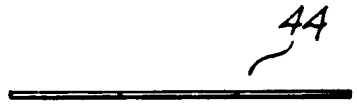

FIGS. 4A and 4B illustrate the different states of a compensation bimetallic washer 44 suitable for use in the preferred embodiment of the invention. The compensation bimetallic washers 44 illustrated in FIGS. 4A and 4B are responsive to temperature changes as set forth in the above example. As noted above, the compensation bimetallic washer 44 flattens with increasing temperatures and becomes flat at a high temperature, for example, above 100° C. (FIG. 4A). In further keeping with the above example, the compensation bimetallic washer 44 deflects a distance, denoted $d_w$, with decreasing temperatures less than 100° C., so as to become conical (FIG. 4B). In one particular working model of the invention, $d_w$ attains a maximum value of 0.015 inches at a low temperature, such as −30° C. Obviously, for temperatures between −30° C. and 100° C., $d_w$ has a value between zero and 0.015 inches. (As will be discussed below, in an alternative embodiment of the tuning screw 22, loading bimetallic washers (76) (FIG. 3) function in an opposite manner. That is, for the same range of temperatures, i.e., −30° C. to 100° C., the loading bimetallic washers (76) are preferably approaching a flat state at −30° C. and achieve a maximum deflection at 100° C.)

Bimetals are generally well known and, therefore, are not discussed in detail herein. Basically, a bimetal is a laminate of two dissimilar metals, with different coefficients of thermal expansion, bonded together. Hence, the bimetal deflects when the temperature changes. The compensation bimetallic washers 44 used in the particular working model of the temperature-compensated tuning screw 22 described above (and the loading bimetallic washers (76) (FIG. 3) discussed below) are manufactured from a bimetal identified as TRUFLEX P675R, which is produced by Crest Manufacturing Company. As a result, the bimetallic washers 44 and 76 deflect in accordance with the temperature/deflection characteristics of the TRUFLEX P675R material. Obviously, bimetallic washers having different temperature/deflection characteristics can be used, as required by the needs of a particular application of a temperature-compensated tuning screw 22 formed in accordance with this invention.

In the particular working model of the temperature-compensated tuning screw 22 discussed above, the deflection of the chosen compensation bimetallic washers 44 is substantially linear with respect to temperature changes for temperatures between −30° C. and 100° C. A linear relationship between deflection distance, $d_w$, and temperature change, is desirable where the frequency drift, Δf, of a cavity filter is linearly related to temperature change. In such an application, the linear relationship between $d_w$ and temperature change results in a temperature-compensated tuning screw 22 that creates a substantially drift free cavity filter. Obviously, in a cavity filter application where Δf is nonlinearly related to temperature changes, it is desirable to use compensation bimetallic washers 44 that have corresponding nonlinear deflection-temperature characteristics.

As will become better understood from the following discussion, a change in overall length, L, designated ΔL, caused by the extension or retraction of the compensating member 40 results in a corresponding change in penetration, ΔP, when the temperature-compensated tuning screw 22 is connected to a cavity filter. The change in penetration, ΔP, changes the geometry of the cavity in the cavity filter and thereby changes the resonant frequency, f, of the cavity filter by an amount, Δf. As noted above, the overall length, L., decreases with increasing temperature. As a result, penetration, P, also decreases with increasing temperatures. Decreasing temperatures cause L, and therefore P, to increase. Accordingly, in the preferred embodiment of the present invention, the temperature-compensated tuning screw 22 responds to temperature changes in a manner that is opposite to the reaction of the prior art tuning screw 14 discussed above. As will be explained by way of an example set forth below, the change in penetration, ΔP, of the temperature-compensated tuning screw 22 in response to a change in temperature, substantially corrects a corresponding temperature-induced frequency drift, Δf, of the cavity filter.

As will be understood from the preceding discussion, the coil spring 42 exerts an axial force on the compensating member 40. The force produced by the coil spring 42 loads the bimetallic washers 44 so that the compensating member 40 is retracted as the compensation bimetallic washers 44 begin to flatten. Unfortunately, the function of the coil spring 42 may be adversely affected by countering forces when the temperature-compensated tuning screw 22 is used in certain applications. For example, in applications where the tuning screw 22 is subjected to conditions of rapid acceleration or deceleration, the associated high gravitational forces may inadvertently compress the coil spring 42, thereby unloading the compensation bimetallic washers 44. Once the compensation bimetallic washers 44 are unloaded, the compensating member 40 is free to move in and out of the bore 38 independently of the force produced by the compensation bimetallic washers 44. Accordingly, the resulting overall length, L, of the tuning screw 22 may not result in the appropriate penetration, P, to correct a temperature-induced frequency drift, Δf'.

FIG. 3 illustrates an alternative embodiment of the temperature-compensated tuning screw 22 formed in accordance with the invention that is particularly well suited for applications involving high gravitational forces, such as those noted above. The elements of this alternative embodiment, which are similar or identical to corresponding elements in the preferred embodiment of the tuning screw 22 (FIG. 1), are identified by prime reference numerals. Because these elements are similar or identical to those discussed above, they are not discussed in detail below. However, elements in the alternative embodiment that are different from the corresponding elements in the preferred embodiment are discussed below in more detail.

In this embodiment, a tuning screw 22' includes a second set of bimetallic washers, hereinafter referred to as loading bimetallic washers 76, in place of the coil spring 42 (FIG. 2). The loading bimetallic washers 76 are also responsive to temperature change. The loading bimetallic washers 76 are "stacked" atop one another about a shaft 64'. The loading bimetallic washers 76 are held in place by a shoulder formed by the junction between a shaft region 50' and a neck region 54' and a retaining washer 72'. The shaft region 50' has a diameter substantially equal to the diameter of the head region 52' in the FIG. 3 embodiment of the invention in order to accommodate the loading bimetallic washers 76 sized the same as compensation bimetallic washers 44'. The tuning screw 22' has a cylindrical elongate body 36' with an integral external hexagonal head 37'. An internal hexagonal opening (such as the opening 78 illustrated in FIG. 2) cannot be used with this alternative embodiment, because such an opening would prevent the loading bimetallic washers 76 from being inserted into the shaft region 50'.

Like the coil spring 42, the loading bimetallic washers 76 load the compensation bimetallic washers 44'. To accomplish this loading function, the loading bimetallic washers 76 respond to temperature changes differently than the compensation bimetallic washers 44'. More specifically, the loading bimetallic washers 76 flatten when the temperature decreases and deflect to a conical shape when the temperature increases. Accordingly, the compensation bimetallic washers 44' and the loading bimetallic washers 76 work cooperatively to move a compensating member 40'. For example, as the temperature increases, the compensation bimetallic washers 44' begin to flatten and the loading bimetallic washers 76 begin to deflect and become conical, thereby causing the compensating member 40' to be retracted into the head region 52' of a bore 38'. When the temperature decreases, the compensation bimetallic washers 44' begin to deflect and become conical and the loading bimetallic washers 76 begin to flatten, thereby causing the compensating member 40' to move out (i.e., protrude) from the head region 52' of the bore 38'. The alternative embodiment of the tuning screw 22' illustrated in FIG. 3 is better suited for high gravitational force applications than the tuning screw 22 discussed above and illustrated in FIG. 2 because a greater force is required to compress the loading bimetallic washers 76 than the coil spring 42.

Figure 5:
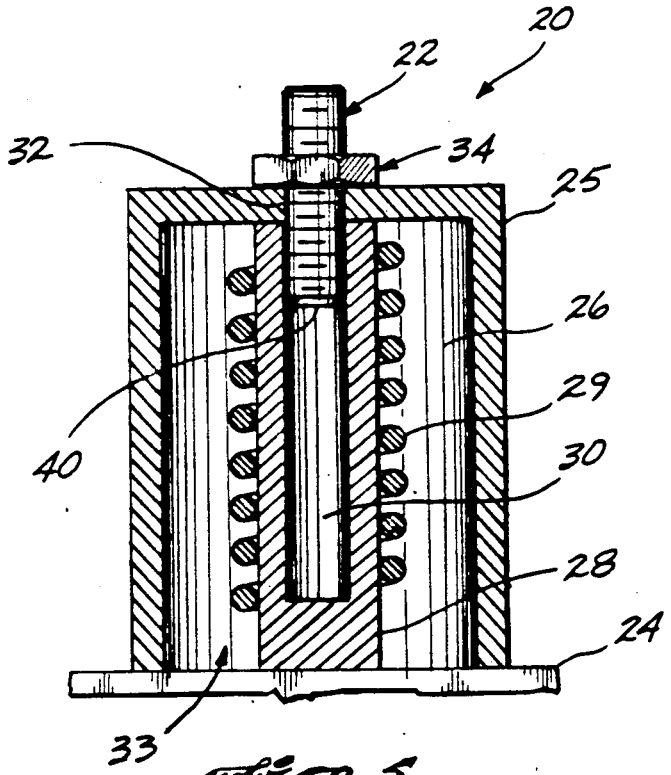

FIG. 5 illustrates a temperature-compensated tuning screw 22 formed in accordance with the present invention mounted in a cavity filter 20. The cavity filter 20 is a cavity filter of the helical coil resonator type. While a helical coil resonator-type cavity filter 20 is discussed herein, it is to be understood that the tuning screw 22 can be used with other types of cavity filters to correct frequency drift problems. The cavity filter 20 illustrated in FIG. 5 has a metallic base 24 and a metal case 25 that form within their walls a resonant cavity 26. A coil form 28 is located within the cavity 26 and extends between the base 24 and an opposite wall of the case 25. The coil form 28 contains a bore 30 that extends from an end of the coil form 28 adjacent the case 25 and terminates short of an end of the bore 30 adjacent the base 24. The case 25 has a threaded hole 32 that is aligned with the bore 30. The temperature-compensated tuning screw 22 is screwed into the hole 32 and secured, for example, by a lockdown nut 34. The case 25 is formed with an opening 33 opposite the threaded hole 32 which is covered by the base 24.

Cavity filters 20 of the helical coil resonator type are well known in the cavity filter art and therefore will not be described in detail herein. For purposes of the present invention, it is sufficient to note that the cavity filter 20 has a resonant frequency, f, determined, in part, by electrical characteristics (i.e., capacitance and inductance values) of the cavity 26, the helical coil 29, the coil form 28 and the bore 30. Furthermore, the capacitance and inductance values vary with changing temperature as the geometry of the elements changes. As will become better understood from the following discussion, the tuning screw 22 compensates for the changes in the capacitance and inductance of the cavity filter 20 by changing the penetration of the cavity screw, ΔP, into the bore 30. As a result, the temperature-compensated tuning screw 22 reduces the temperature-induced frequency drift, Δf', of the cavity filter 20.

The temperature-compensated tuning screw 22 can be screwed into the hole 32 so as to tune the cavity filter 20 to a nominal resonant frequency, f. Accordingly, at a nominal temperature, T, the cavity filter 20 is tuned to the nominal resonant frequency, f. As the operating temperature of the cavity filter 22 varies from the nominal temperature, T, the overall length, L, of the temperature-compensated tuning screw 22 changes in the manner described above to compensate for the changing geometry of the cavity filter 20 resulting in the overall capacitance/inductance ratio remaining substantially constant. As discussed above, the temperature-compensated tuning screw 22 adjusts its overall length, L, and, therefore, the penetration, P, into the bore 30, by extending or retracting the compensating member 40 a distance ΔP. More specifically, the temperature-compensated tuning screw 22 reduces its penetration as temperature increases, and increases its penetration as temperature decreases. The corresponding ΔP changes substantially compensates for temperature-induced changes in the geometry of the cavity filter 20 so as to maintain the capacitance/inductance ratio substantially constant. As a result, the temperature-compensated tuning screw 20 substantially reduces, if not entirely eliminates, temperature-induced frequency drift.

An illustrative example of how to determine the type and number of compensation bimetallic washers 44 necessary to permit the temperature-compensated tuning screw 22 to substantially correct the Δf' of a cavity filter, such as the cavity filter 20 depicted in FIG. 5 and discussed above, is set forth below. In general, once the drift characteristics of the cavity filter 20 are determined, the proper type and number of compensation bimetallic washers 44 can be selected. The drift characteristics of a cavity filter can be determined from empirical data by monitoring the output of the filter as temperature is varied. From empirical test data, it can be shown that the resonant frequency drift, Δf', of cavity filter 20 of the type illustrated in FIG. 5 can be approximated by the following linear equation:

$$|\Delta f'| = 0.0035 \cdot |\Delta T| \quad (1)$$

where:

Δf' is the temperature-induced change in resonant frequency from the nominal resonant frequency, f, measured in MHz; and, ΔT is the change in temperature from the nominal temperature, T, at which the nominal resonant frequency is set, measured in degrees Celsius.

Next, a relationship between ΔP and Δf for the cavity filter 20 can be determined from additional empirical data. Specifically, the change in the resonant frequency of the cavity filter 20 is measured as the penetration, P, of tuning screw 22 is manually varied. For a cavity filter of the type illustrated in FIG. 5, this relationship may be approximated by the following linear equation:

$$|\Delta P| = 0.0138 \cdot |\Delta f| \quad (2)$$

where:

Δf is the change in resonant frequency caused by the changing penetration of the tuning screw 22, measured in MHz; and, ΔP is in inches.

Solving Equation (2) for Δf and substituting it into Equation (1) for Δf' creates the following linear equation:

$$|\Delta P| = 4.83 \cdot 10^{-5} \cdot |\Delta T|. \quad (3)$$

Equation (3) represents a linear relationship between the change in penetration, ΔP, of the tuning screw 22 and temperature change, ΔT. As can be seen from Equation (2), this value of ΔP corresponds to the resonant frequency drift, Δf', associated with the particular value of ΔT. Obviously, if compensation bimetallic washers 44 can be selected so that the absolute value of ΔP (i.e., |ΔP|) for the temperature-compensated tuning screw 22 is equal to the absolute value of the computed ΔP value in Equation (3), but in the opposite direction, then Δf' will be compensated for, i.e., no resonant frequency drift will occur as temperature changes occur.

By selecting compensation bimetallic washers 44 made from the TRUFLEX P675R material discussed above, the deflection, $d_w$, for each compensation bimetallic washer 44 can be represented by the following equation:

$$|d_w| = 9.23 \cdot 10^{-6} |\Delta T|. \quad (4)$$

From the relationships set forth in Equations (3) and (4), the number of compensation bimetallic washers 44 needed by the tuning screw to compensate for the resonant frequency drift, $\Delta f'$, of the cavity filter 20 can be easily computed by dividing Equation (4) into Equation (3), which, in the above example, equates to 5.2 compensation bimetallic washers 44.

In the foregoing example, Equation (2) was determined from empirical data obtained by manually rotating the tuning screw 22 so as to change P. In doing so, $\Delta P$ is caused by changing the penetration of the body 36. Since the diameter of the compensating member 40 is less than the diameter of the body 36 (see FIG. 2), a correction factor is necessary to correct the number of compensation bimetallic washers 44 computed above. In the above example, a suitable correction factor is 1.2. As a result, six compensation bimetallic washers 44 ($5.2 \times 1.2 = 6.24$) are actually necessary to best correct for resonant frequency drift in this example. Obviously, if the relationship between $\Delta f'$ and $\Delta T$ is different than that set forth in Equation (1), a different number of compensation bimetallic washers 44 may be necessary. Thus, by selecting the proper type and number of compensation bimetallic washers 44, the temperature-compensated tuning screw 22 of the present invention can be used with an assortment of cavity filters having different frequency drift characteristics.

As can be readily appreciated from the foregoing description, the present invention provides a temperature-compensated tuning screw that compensates for temperature-induced changes in the resonant frequency of a cavity filter. While preferred and alternative embodiments of the invention and an example of a particular application of the invention have been illustrated and discussed herein, it is to be understood that within the scope of the appended claims various changes can be made. For example, different numbers and/or types of compensation bimetallic washers can be used to suit the particular cavity filter application. In an application where the penetration of the tuning screw must increase with increasing temperature, other types of compensation bimetallic washers must be used. In general, it is to be understood that a temperature-compensated tuning screw 22 formed in accordance with the invention can be used with any type of cavity filter whose tuned frequency is affected by temperature. Hence, it is to be understood that the invention can be practiced otherwise than as specifically described herein.

The embodiments of the invention in which an exclusive property or privilege is claimed are defined as follow:

1. A temperature-compensated cavity filter comprising:

(a) a metallic case defining a resonant cavity, said case having a hole formed therein; and (b) a tuning screw mounted in said case hole and protruding into said cavity, said tuning screw including: an elongate body having a longitudinal bore; a thermal compensating member positioned at least partially within said longitudinal bore; at least one compensation bimetallic washer having top and bottom surfaces, said at least one compensation bimetallic washer disposed in said longitudinal bore adjacent said thermal compensating member and being flat at a first temperature, whereby changes in temperature in a first direction cause said at least one compensation bimetallic washer to deflect in a direction normal to said top and bottom surfaces so that said at least one compensation bimetallic washer moves said thermal compensating member in a first direction and said at least one compensation bimetallic washer has a maximum deflection at a second temperature; and a biasing means disposed in said longitudinal bore adjacent said thermal compensating member for loading said at least one compensating bimetallic washer and moving said thermal compensating member in a second direction opposite said first direction.

2. A tuning screw for use with a cavity filter having a resonant frequency that drifts in response to changes in temperature, said tuning screw comprising:

(a) an elongate body having a longitudinal bore;

(b) a thermal compensating member positioned at least partially within said longitudinal bore;

(c) at least one compensation bimetallic washer having top and bottom surfaces, said at least one compensation bimetallic washer disposed in a portion of said longitudinal bore adjacent to a first portion of said thermal compensating member and disposed around a second portion of said thermal compensating member for moving said thermal compensating member in a first direction in response to changes in temperature in a first direction; and, (d) a biasing means disposed in said longitudinal bore adjacent said thermal compensating member for loading said at least one compensating bimetallic washer and moving said thermal compensating member in a second direction opposite said first direction.

3. The tuning screw claimed in claim 2, wherein said at least one compensation bimetallic washer is substantially flat at a first temperature, said changes in temperature in said first direction causing said at least one compensation bimetallic washer to deflect in a direction normal to said top and bottom surfaces, said at least one compensation bimetallic washer attaining a maximum deflection at a second temperature.

4. The tuning screw claimed in claim 3, wherein a magnitude of said deflection of said at least one compensation bimetallic washer is linearly related to said changes in temperature.

5. The tuning screw claimed in claim 4, wherein said maximum deflection of said at least one compensation bimetallic washer is 0.015 inches.

6. The tuning screw claimed in claim 3, wherein said first temperature is higher than said second temperature.

7. The tuning screw claimed in claim 6, wherein a magnitude of said deflection of said at least one compensation bimetallic washer is linearly related to said changes in temperature.

8. The tuning screw claimed in claim 7, wherein said maximum deflection of said at least one compensation bimetallic washer is 0.015 inches.

9. The tuning screw claimed in claim 8, wherein said first temperature is greater than 100° C. and said second temperature is less than −30° C.

10. The tuning screw claimed in claim 2, wherein said elongate body has external threads substantially along a length of said elongate body.

11. The tuning screw claimed in claim 2, wherein said longitudinal bore comprises:

(a) a neck region having a first open end and a second open end opposite said first open end;

(b) a shaft region having an open end and a shoulder opposite said open end, said shoulder formed where said shaft region joins said first open end of said neck region; and, (c) a head region having an open end and a shoulder opposite said open end, said shoulder formed where said head region joins said second open end of said neck region.

12. The tuning screw claimed in claim 11, wherein (a) said compensation member second portion comprising a shaft having a first end and a second end, said shaft passing through said neck region such that said first end lies within said shaft region and said second end lies within said head region; and, (b) said compensation member first portion comprising a head having a front surface and a back surface, said back surface of said head being connected to said second end of said shaft, said head being positioned substantially within said head region.

13. The tuning screw claimed in claim 2, wherein said shaft of said thermal compensating member passes through said at least one compensation bimetallic washer such that said at least one compensation bimetallic washer is positioned between said back surface of said head and said shoulder of said longitudinal bore head region.

14. The tuning screw claimed in claim 13, wherein said at least one compensation bimetallic washer is substantially flat at a first temperature, said changes in temperature in said first direction causing said at least one compensation bimetallic washer to deflect in a direction normal to said top and bottom surfaces, said at least one compensation bimetallic washer attaining a maximum deflection at a second temperature.

15. The tuning screw claimed in claim 14, wherein a magnitude of said deflection of said at least one compensation bimetallic washer is linearly related to said changes in temperature.

16. The tuning screw claimed in claim 15, wherein said maximum deflection of said at least one compensation bimetallic washer is 0.015 inches.

17. The tuning screw claimed in claim 14, wherein said first temperature is higher than said second temperature.

18. The tuning screw claimed in claim 17, wherein a magnitude of said deflection of said at least one compensation bimetallic washer is linearly related to changes in temperature.

19. The tuning screw claimed in claim 18, wherein said maximum deflection of said at least one compensation bimetallic washer is 0.015 inches.

20. The tuning screw claimed in claim 19, wherein said first temperature is greater than 100° C. and said second temperature is less than −30° C.

21. The tuning screw claimed in claim 2, wherein said biasing means is held in compression between said first end of said shaft and said shoulder of said shaft region.

22. The tuning screw claimed in claim 21, wherein said biasing means is a coil spring and said shaft passes through said coil spring.

23. The tuning screw claimed in claim 2, wherein said biasing means comprises at least one loading bimetallic washer disposed in said longitudinal bore shaft region adjacent said thermal compensating member for moving said thermal compensating member in said second direction in response to changes in temperature opposite said first direction temperature changes.

24. The tuning screw claimed in claim 23, wherein said at least one loading bimetallic washer has a top surface and a bottom surface.

25. The tuning screw claimed in claim 24, wherein said at least one loading bimetallic washer is substantially flat at a second temperature, said changes in temperature in said second direction causing said at least one loading bimetallic washer to deflect in a direction normal to said top and bottom surfaces, said at least one loading bimetallic washer attaining a maximum deflection at a first temperature.

26. The tuning screw claimed in claims 22 or 25, wherein said at least one compensation bimetallic washer is substantially flat at said first temperature, said changes in temperature in said first direction causing said at least one compensation bimetallic washer to deflect in a direction normal to said top and bottom surfaces, said at least one compensation bimetallic washer attaining a maximum deflection at said second temperature.

27. The tuning screw claimed in claim 26, wherein a magnitude of said deflection of said at least one compensation bimetallic washer and a magnitude of said deflection of said at least one loading bimetallic washer are linearly related to said changes in temperature.

28. The tuning screw claimed in claim 27, wherein said first temperature is higher than said second temperature.

29. The tuning screw claimed in claim 28, wherein said first temperature is greater than 100° C. and said second temperature is less than −30° C.

30. The tuning screw of claim 29, wherein said maximum deflection of said at least one compensation bimetallic washer and of said at least one loading bimetallic washer is 0.015 inches.

31. The tuning screw claimed in claim 2, wherein said elongate body and said thermal compensating member are made of a conductive, nonmagnetic material.

32. The tuning screw claimed in claim 1, wherein said conductive, nonmagnetic material is brass.

33. The temperature-compensated cavity filter comprising:

a) a metallic case defining a resonant cavity, said case having a hole formed therein; and b) a tuning screw mounted in said case hole and protruding into said cavity, said tuning screw including: an elongate body having a longitudinal bore; a thermal compensating member positioned at least partially within said longitudinal bore; at least one compensation bimetallic washer having top and bottom surfaces, said compensation bimetallic washer disposed in said longitudinal bore adjacent to a first portion of said thermal compensating member and disposed around a second portion of said thermal compensating member for moving said thermal compensating member in a first direction in response to changes in temperature in a first direction; and a biasing means disposed in said longitudinal bore adjacent said thermal compensating member for loading said at least one bimetallic washer and moving said thermal compensating member in a second direction opposite said first direction.

34. The temperature-compensating cavity of claim 33 wherein said case defines an opening and a base member is attached to said case over said opening so as to define said resonant cavity.

35. The temperature-compensated cavity filter claimed in claim 33, wherein said longitudinal bore in said elongate body comprises:

(a) a neck region having a first open end and a second open end opposite said first open end;

(b) a shaft region having an open end and a shoulder opposite said open end, said shoulder formed where said shaft region joins said first open end of said neck region; and, (c) a head region having an open end and a shoulder opposite said open end, said shoulder formed where said head region joins said second open end of said neck region.

36. The temperature-compensated cavity filter claimed in claim 35, wherein:

(a) said compensation member second portion comprising a shaft having a first end and a second end, said shaft passing through said neck region such that said first end lies within said shaft region and said second end lies within said head region; and, (b) said compensation member first portion comprising a head having a front surface and a back surface, said back surface of said head being connected to said second end of said shaft, said head being positioned substantially within said head region.

37. The temperature-compensated cavity firlter claimed in claim 36, wherein said shaft of said thermal compensating member passes through said at least one compensation bimetallic washer and said at least one compensation bimetallic washer is positioned between said back surface of said head and said longitudinal bore head region.

38. The temperature-compensated cavity filter claimed in claim 37, wherein said at least one compensation bimetallic washer is substantially flat at a first temperature, said changes in temperature in said first direction causing said at least one compensation bimetallic washer to deflect in a direction normal to said top and bottom surfaces, said at least one compensation bimetallic washer attaining a maximum deflection at a second temperature.

39. The temperature-compensated cavity filter claimed in claim 38, wherein said biasing means comprises at least one loading bimetallic washer responsive to said changes in temperature for moving said compensation member in said second direction in response to changes in temperature in a second direction opposite said first direction, said at least one loading bimetallic washer is held in position between said first end of said shaft and said shoulder of said shaft region, said at least one loading bimetallic washer having a top and bottom surface.

40. The temperature-compensated cavity filter claimed in claim 39, wherein said at least one loading bimetallic washer is substantially flat at said second temperature, said changes in temperature in said second direction causing said at least one loading bimetallic washer to deflect in a direction normal to said top and bottom surfaces, said at least one loading bimetallic washer attaining a maximum deflection at said first temperature.

41. The temperature-compensated cavity filter claimed in claim 38, wherein said biasing means is a coil spring, wherein said shaft passes through said coil spring, said coil spring is held in compression between said first end of said shaft and said shoulder of said shaft region.

42. The temperature-compensated cavity filter claimed in claims 41 or 39, wherein said first temperature is higher than said second temperature.

43. The temperature-compensated cavity filter claimed in claim 42, wherein said maximum deflection of each of said at least one compensation bimetallic washers and each of said at least one loading bimetallic washers is 0.015 inches.

44. The temperature-compensated cavity filter claimed in claim 43, wherein said body and said compensating member are made of a conductive, nonmagnetic material.

45. The temperature-compensated cavity filter claimed in claim 44, wherein said conductive, nonmagnetic material is brass.

46. A tuning screw for use with a cavity filter having a resonant frequency that drifts in response to changes in temperature, said tuning screw comprising:

(a) an elongate body having a longitudinal bore;

(b) a thermal compensating member positioned at least partially within said longitudinal bore;

(c) at least one compensation bimetallic washer having top and bottom surfaces, said at least one compensation bimetallic washer disposed in said longitudinal bore adjacent said thermal compensating member and being flat at a first temperature, whereby changes in temperature in a first direction cause said at least one compensation bimetallic washer to deflect in a direction normal to said top and bottom surfaces so that said at least one compensation bimetallic washer moves said thermal compensating member in a first direction and said at least one compensation bimetallic washer has a maximum deflection at a second temperature; and (d) a biasing means disposed in said longitudinal bore adjacent said thermal compensating member for loading said at least one compensating bimetallic washer and moving said thermal compensating member in a second direction opposite said first direction.

* * * * *

UNITED STATES PATENT AND TRADEMARK OFFICE

CERTIFICATE OF CORRECTION

PATENT NO. : 5,039,966

DATED : August 13, 1991

INVENTOR(S) : Hartmut Schmid et al.

It is certified that error appears in the above-identified patent and that said Letters Patent is hereby corrected as shown below:

| Column | Line | |
|---|---|---|
| 4 | 58 | "compesatory" should be --compensatory-- |
| 9 | 19 | "metal" should be --metallic-- |
| 13 | 23 | "Claim 2" should be --Claim 12-- |
| 13 | 58 | "Claim 2" should be --Claim 12-- |
| 13 | 64 | "Claim 2" should be --Claim 12-- |
| 16 | 17 | "claims 41 or 39" should be --claims 41 or 40-- |

Signed and Sealed this

Thirteenth Day of April, 1993

*Attest:*

STEPHEN G. KUNIN

*Attesting Officer*

*Acting Commissioner of Patents and Trademarks*